US008062737B2

(12) United States Patent
Abrams et al.

(10) Patent No.: US 8,062,737 B2
(45) **Date of Patent: *Nov. 22, 2011**

(54) SECURITY INFORMATION AND GRAPHIC IMAGE FUSION

(76) Inventors: Fredric Louis Abrams, Dayton, OH (US); Robert Frank Freund, Centerville, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/056,682

(22) Filed: Mar. 27, 2008

(65) Prior Publication Data

US 2008/0176011 A1 Jul. 24, 2008

Related U.S. Application Data

(60) Division of application No. 11/001,548, filed on Dec. 1, 2004, now Pat. No. 7,927,688, which is a continuation-in-part of application No. 10/389,831, filed on Mar. 17, 2003, now Pat. No. 7,166,249, which is a division of application No. 09/521,127, filed on Mar. 7, 2000, now Pat. No. 6,544,634.

(60) Provisional application No. 60/125,316, filed on Mar. 19, 1999.

(51) Int. Cl.
*B41M 5/00* (2006.01)

(52) U.S. Cl. ..... 428/195.1; 340/572.1

(58) Field of Classification Search ..... 340/572.1; 428/195.1

See application file for complete search history.

(56) References Cited

U.S. PATENT DOCUMENTS

| | | | | |
|---|---|---|---|---|
| 4,321,404 | A | 3/1982 | Williams et al. | |
| 4,330,578 | A | 5/1982 | Nishihira et al. | |
| 4,369,157 | A | 1/1983 | Conner | |
| 4,418,033 | A | 11/1983 | Hatakeyama | |
| 4,427,615 | A | 1/1984 | Eskesen | |
| 4,544,184 | A | 10/1985 | Freund et al. | |
| 4,574,366 | A * | 3/1986 | Potember et al. | 365/153 |
| 4,650,533 | A | 3/1987 | Parker et al. | |
| 4,808,366 | A | 2/1989 | Kaminski et al. | |
| 4,861,644 | A * | 8/1989 | Young et al. | 428/195.1 |
| 4,892,779 | A | 1/1990 | Leatherman et al. | |
| 4,904,324 | A | 2/1990 | Heider | |
| 4,983,348 | A | 1/1991 | Barresi et al. | |
| 5,172,936 | A | 12/1992 | Sullivan et al. | |
| 5,227,222 | A | 7/1993 | Ogawa et al. | |
| 5,324,567 | A * | 6/1994 | Bratchley et al. | 428/195.1 |
| 5,338,396 | A | 8/1994 | Abdala et al. | |
| 5,401,457 | A | 3/1995 | Valyi | |
| 5,435,963 | A | 7/1995 | Rackovan et al. | |
| 5,492,370 | A * | 2/1996 | Chatwin et al. | 283/110 |
| 5,512,227 | A | 4/1996 | Grazioli | |
| 5,514,427 | A | 5/1996 | Ellison et al. | |
| 5,522,623 | A * | 6/1996 | Soules et al. | 283/91 |
| 5,536,539 | A | 7/1996 | Ellison et al. | |
| 5,591,384 | A | 1/1997 | Abrams et al. | |
| 5,626,339 | A | 5/1997 | Schickert et al. | |
| 5,629,029 | A | 5/1997 | Souder et al. | |
| 5,637,329 | A | 6/1997 | Abrams | |
| 5,658,672 | A | 8/1997 | Lenke et al. | |
| 5,676,981 | A | 10/1997 | Miyazawa et al. | |
| 5,686,504 | A | 11/1997 | Ang | |
| 5,698,283 | A | 12/1997 | Yamasaki et al. | |
| 5,705,255 | A | 1/1998 | Grazioli | |
| 5,707,472 | A * | 1/1998 | Smith | 156/240 |
| 5,711,839 | A * | 1/1998 | Dronzek, Jr. | 156/277 |
| 5,795,527 | A | 8/1998 | Nakamura et al. | |
| 5,800,757 | A | 9/1998 | Abrams et al. | |
| 5,897,741 | A | 4/1999 | Mills et al. | |
| 5,914,170 | A | 6/1999 | Rabe et al. | |
| 5,935,692 | A | 8/1999 | Smith | |
| 5,937,554 | A * | 8/1999 | Haugk et al. | 40/310 |
| 5,951,055 | A * | 9/1999 | Mowry, Jr. | 283/93 |
| 6,001,292 | A | 12/1999 | Atake | |
| 6,004,682 | A | 12/1999 | Rackovan et al. | |
| 6,007,759 | A | 12/1999 | Ten Tije et al. | |
| 6,025,068 | A * | 2/2000 | Pekala | 428/315.5 |
| 6,028,518 | A | 2/2000 | Rankin et al. | |
| 6,089,611 | A * | 7/2000 | Blank | 283/67 |
| 6,106,110 | A * | 8/2000 | Gundjian et al. | 347/86 |
| 6,107,920 | A | 8/2000 | Eberhardt et al. | |
| 6,114,023 | A * | 9/2000 | Schwarz et al. | 428/315.5 |
| 6,165,576 | A | 12/2000 | Freedman et al. | |

(Continued)

FOREIGN PATENT DOCUMENTS

DE 10220502 A1 11/2003

(Continued)

OTHER PUBLICATIONS

International Search Report and Written Opinion dated Jun. 30, 2006 pertaining to International application No. PCT/US05/27387.

(Continued)

*Primary Examiner* — Bruce H Hess
*Assistant Examiner* — Tamra L Amakwe
(74) *Attorney, Agent, or Firm* — Dinsmore & Shohl LLP

(57) ABSTRACT

A security information and graphic image fusion system to be used with verification equipment to provide a tamper proof labeled article having security information thereon. The label comprises a printable sheet having at least one invisible IR or UV image, or both, printed thereon, at least one visible image printed thereon, and an over-coating layer thereon. The invisible IR or UV image, or both, provide security information. The visible image provides the graphic image. The label is permanently fused by an in-mold molding process to an article made of plastic, rubber or the combination thereof to render it tamper proof.

5 Claims, No Drawings

U.S. PATENT DOCUMENTS

| | | | | |
|---|---|---|---|---|
| 6,236,753 | B1 | 5/2001 | Inamoto | |
| 6,280,544 | B1 | 8/2001 | Fox et al. | |
| 6,319,682 | B1 * | 11/2001 | Hochman | 435/29 |
| 6,357,799 | B1 * | 3/2002 | Shibata et al. | 283/91 |
| 6,417,904 | B1 | 7/2002 | Yamaoka et al. | |
| 6,494,943 | B1 * | 12/2002 | Yu et al. | 106/31.65 |
| 6,544,634 | B1 * | 4/2003 | Abrams et al. | 428/212 |
| 6,569,280 | B1 | 5/2003 | Mehta et al. | |
| 6,661,339 | B2 | 12/2003 | Muirhead | |
| 6,692,799 | B2 * | 2/2004 | Waller, Jr. | 428/32.23 |
| 6,837,959 | B2 * | 1/2005 | Daems et al. | 156/269 |
| 6,898,458 | B2 * | 5/2005 | Zeng et al. | 600/476 |
| 6,943,678 | B2 | 9/2005 | Muirhead | |
| 6,990,723 | B1 | 1/2006 | Hoogland | |
| 7,119,129 | B2 * | 10/2006 | Krohn | 522/92 |
| 7,166,249 | B2 * | 1/2007 | Abrams et al. | 264/132 |
| 7,259,856 | B2 * | 8/2007 | Kachanov et al. | 356/437 |
| 7,369,048 | B2 * | 5/2008 | Freund | 340/572.1 |
| 7,377,859 | B2 | 5/2008 | Reardon | |
| 7,806,158 | B2 | 10/2010 | Freund | |
| 7,927,688 | B2 | 4/2011 | Abrams et al. | |
| 2002/0103439 | A1 * | 8/2002 | Zeng et al. | 600/476 |
| 2002/0195195 | A1 | 12/2002 | Grabau et al. | |
| 2003/0136503 | A1 * | 7/2003 | Green et al. | 156/264 |
| 2003/0173717 | A1 | 9/2003 | Abrams et al. | |
| 2004/0074973 | A1 | 4/2004 | Schneck et al. | |
| 2004/0083918 | A1 | 5/2004 | Jack | |
| 2004/0094949 | A1 | 5/2004 | Savagian et al. | |
| 2004/0168618 | A1 | 9/2004 | Muirhead | |
| 2004/0209063 | A1 * | 10/2004 | Gallagher et al. | 428/304.4 |
| 2004/0224786 | A1 | 11/2004 | Reardon | |
| 2004/0238098 | A1 | 12/2004 | Beckmann et al. | |
| 2004/0238623 | A1 | 12/2004 | Asp | |
| 2005/0237184 | A1 | 10/2005 | Muirhead | |
| 2005/0241548 | A1 | 11/2005 | Muirhead | |
| 2006/0086013 | A1 | 4/2006 | Stegman et al. | |
| 2006/0176180 | A1 * | 8/2006 | Freund | 340/572.8 |
| 2007/0079928 | A1 * | 4/2007 | Abrams et al. | 156/244.11 |
| 2007/0154677 | A1 * | 7/2007 | Abrams et al. | 428/64.4 |
| 2007/0243367 | A1 | 10/2007 | Nagatake et al. | |
| 2008/0173405 | A1 * | 7/2008 | Freund | 156/510 |
| 2008/0176011 | A1 * | 7/2008 | Abrams et al. | 428/29 |

FOREIGN PATENT DOCUMENTS

| | | | |
|---|---|---|---|
| EP | 1 824 673 | | 8/2007 |
| EP | 1 910 981 | | 4/2008 |
| GB | 2327906 | | 2/1999 |
| JP | 10128789 | A | 5/1998 |
| MX | 2007006502 | A | 9/2007 |
| WO | 95/32088 | A1 | 11/1995 |
| WO | 98/15414 | | 4/1998 |
| WO | 03/069552 | A1 | 8/2003 |
| WO | 2006/060043 | A2 | 6/2006 |
| WO | 2007/064361 | A2 | 6/2007 |

OTHER PUBLICATIONS

International Search Report and Written Opinion dated Oct. 9, 2007 pertaining to International application No. PCT/US06/24709.

Supplementary European Search Report dated Jul. 15, 2009 pertaining to EP application No. 05778217.9.

Brazilian Patent Application No. PI 0518797-4 filed Aug. 2, 2005 in the name of Fusion Graphics, Inc.

Canadian Patent Application No. 2588897 filed Aug. 2, 2005 in the name of Fusion Graphics, Inc.

IBM Technical Disclosure Bulletin; Mar. 1, 1996; pp. 129-130; vol. 39, Issue #3; 0018-8689-39-3-129.

Notice of Allowance mailed Jan. 26, 2011 as it pertains to U.S. Appl. No. 11/001,548.

Supplementary European Search Report dated Oct. 18, 2010 in reference to co-pending European Patent Application No. 06847448.5.

* cited by examiner

SECURITY INFORMATION AND GRAPHIC IMAGE FUSION

CROSS REFERENCE TO RELATED APPLICATIONS

This application is a division of U.S. application Ser. No. 11/001,548 filed Dec. 1, 2004, now U.S. Pat. No. 7,927,688, which is a continuation-in-part of U.S. application Ser. No. 10/389,831 filed Mar. 17, 2003 now U.S. Pat. No. 7,166,249, which is a division of U.S. application Ser. No. 09/521,127 filed Mar. 7, 2000 now U.S. Pat. No. 6,544,634 (the disclosure of which is hereby incorporated by reference), which claims the benefit of U.S. provisional application Ser. No. 60/125,316 filed Mar. 19, 1999.

BACKGROUND OF THE INVENTION

The present invention relates to labels and methods of producing labels that may be incorporated into plastic products, rubber products, and the like by fusion to provide security information and a graphic image. The present invention is further related to labels that provide security information, and labeled articles incorporating the labels.

Plastic and rubber materials are used to form and package a wide variety of products. However, many products or packaging may be subject to fraudulent or illegal sale or distribution. Additionally, plastic or rubber products or packaging may be subject to counterfeiting. For example, injectable and oral drugs may be packaged in plastic or rubber packaging, and these drugs may be subject to fraudulent sale or distribution. Such fraudulent use of plastic and rubber products may be detrimental to the health and safety of consumers. Additionally, the fraudulent sale or distribution of plastic and rubber products may adversely affect the profitability of manufacturers and sellers of the products and packaging.

There remains a need in the art for labels that provide authentication and verification of plastic and rubber products.

SUMMARY OF THE INVENTION

The present invention relates to a system for providing security information using a labeled article, a labeled article for use in such a security system, and labels for use in the labeled article. The security system includes a labeled article having a label with at least one invisible IR or UV image (or both) printed thereon to provide security information. The security system includes a verification system such as verification equipment that is programmed to verify the security information.

An in-mold and in-line decorating method is disclosed which, using a single sheet layer, allows the placement of the highest possible quality graphics into the surface of products made from a variety of moldable thermoplastic, thermoset, and vulcanizable materials using a variety of molding processes. The methods also provide new or improved capabilities for product identification, safety, and serialized tracking.

The label comprises a printable sheet, which may be a precipitated silica filled micro-porous material, having at least one invisible IR or UV image, (or both), printed thereon, at least one visible image printed thereon, and a coating over-coating the printable sheet.

The at least one IR image is preferably printed on the printable sheet using inks selected from lithographic, gravure, flexographic, screen inks and combinations thereof, such that the at least one visible image at least partially overlies the at least one IR image. Preferably the IR image has a wavelength of between about 800 angstroms and about 3000 angstroms. A plurality of invisible IR images may be used to provide security information, such as bar codes, or a dot matrix pattern. Most preferred is an invisible IR image configured such that it exhibits an expected change in absorption and reflection in providing the security information.

The at least one invisible UV image is preferably printed on the printable sheet such that it at least partially overlies the at least one visible image. The UV image may be a plurality of invisible UV images with a small variation in wavelength, and may contain a trace molecular chemical to enhance its security feature, which may be in the form of bar codes, or dot matrix pattern, or a block print. As with the IR image, the UV image may exhibit an expected change in absorption and reflection in providing the security information. Likewise a printed sheet having one UV image printed over another UV image, which images are detected using optical spectroscopy, may be used to provide security information.

In the most preferred embodiment, both an invisible IR image(s) and an invisible UV image(s) are used to provide security information.

The label of the present invention may be used to provide a labeled article by permanently in-mold fusing the label to an article made of plastic, rubber or the combination thereof.

DETAILED DESCRIPTION OF THE PREFERRED EMBODIMENTS

In accordance with an embodiment of the present invention, a label comprising a printable sheet, a visible image, and an invisible image is provided. The label may be incorporated into a variety of thermoplastic, thermoset, and rubber material based products, and the label may be fused into the surface of the thermoplastic, thermoset, or rubber material thereby making the label essentially tamper proof. The printable sheet has at least one visible image printed thereon, and the printable sheet has at least one invisible image printed thereon.

The printable sheet may have a thickness of about ten mil or less. The printable sheet is made of a material that can survive the tortuous injection molding environment and one that is in-moldable with a wide variety of thermoplastic and thermoset materials. The printable sheet may be made of any suitable material such as precipitated silica filled micro-porous sheet materials commercially available in the marketplace. Such materials exhibit varying degrees of robustness in the tortuous injection-molding environment. For example, material sold by PPG Industries, Pittsburgh, Pa. under the trade name Teslin or MiST™ is, when properly coated as explained herein, found to be satisfactory for the most demanding molding environments including thermoset applications where the material will be exposed to high temperatures for extended time periods for curing. Other materials, such as Artisyn™ manufactured by Daramic, Inc. of Owensboro, Ky. are generally satisfactory for thermoplastic injection molding applications if treated using layers to improve their tensile properties and stability in the mold. Use of surface treatment layers make ten mil thickness material suitable in all applications and makes seven mil thickness material suitable in many applications.

The visible images, i.e. graphic images, may be printed using any suitable ink. For example, the inks may be selected to produce the highest quality graphic images and survive the molding process while also exhibiting excellent flexibility and resistance to fading in UV light. With respect to said inks, there are families of satisfactory lithographic, gravure, flexographic, and screen inks available in the marketplace from a number of sources by referring to inks suitable for use with PPG Industries Teslin® printable sheet. The use of such inks helps obtain a quality print of visible images on silica-filled micro-porous sheet materials. Reference is made to the Grafusion™ series of lithographic inks and the GRA series of screen inks which have been optimized for the aforementioned silica filled micro-porous materials and which demonstrate the flexibility and robustness to provide and maintain a high quality graphic image through a tortuous injection molding process. Both of these series of inks exhibit exceptional fade resistance in prolonged UV exposure. These inks are available from Fusion Graphics of Dayton, Ohio. Such inks comprise a pigment and carrier which are formulated to withstand temperatures of up to 600° F. The visible images may be printed in any suitable manner. For example, the visible images may be printed utilizing lithography, screen printing, flexography, high resolution ink jet printing, and color or monochrome electrostatic laser printing.

The invisible image may be formed in any suitable manner. For example, the invisible image may be an IR image. The IR image may be printed with any suitable IR ink. Suitable IR inks are generally inks that are visible only under light that is at or near IR in wavelength. For example, the ink may be visible under light having a wavelength of from about 800 angstroms to about 3000 angstroms. On the other hand, an invisible image, which may be a UV image, may be printed over the visible image and, then, excited by a UV light source. Preferably the label of the present invention has both an IR image and a UV image printed thereon. Flint Ink Corp. of Franklin, Ohio, Kennedy Ink Co., of Dayton, Ohio and Angstrom Technologies, Inc. of Erlanger, Ky. provide both UV and IR inks.

The invisible image is configured to provide security information. For example, the IR image may be one image or a plurality of images, and the IR image may be any suitable image. Suitable images include, but are not limited to, a bar code or a dot matrix pattern. The bar code or dot matrix pattern may comprise the security information. Images may comprise a multilayer logo with two wavelengths of electronically detectable and readable data, like a solid bar with a variable bar printed directly on top yet only seen with electronic detection and spectroscopy. The IR images may be printed in any suitable manner. For example, the IR images may be printed utilizing lithography, screen printing, flexography, high-resolution ink jet printing, and color or monochrome electrostatic laser printing.

It will be understood that the IR image formed from IR ink may be excited by an IR light source and read electronically to detect the presence and shape of the IR image. The same is true for UV inks. Thus, the presence of the security information may be verified, and the security information may be read to provide information such as the authenticity of the label. Additionally, the IR image may be read by electronic equipment to detect the rise and fall of the rates of absorption and reflection of the IR image. The rates of absorption and reflection are traits that may be controlled during the manufacturing process of the label, and these traits provide information that may be provided to verification equipment. Thus, these traits may additionally comprise security information. The verification equipment may then be used to verify the identity and authenticity of the label by reading the security information provided by the IR image. The printed IR or UV image can be electronically detected by illuminating the images with an appropriate light source and reading them with a filtered CCD electronic camera. Using the camera and a computer it is possible to detect a variation less than 0.05% in difference. These images cannot be seen with the eye or with any other photographic technologies and since the wavelengths to be detected and the images are only a few wavelengths apart, it is extremely difficult to impossible to replicate the chemical response and print correct intensity in the blind.

The printable sheet may have a layer or layers over the printable sheet that aid the molding process and provide added permanence to the printed image in abrasive, chemical, or UV light exposure environments. The over-casting layers may be applied in any suitable manner. For example, the layers may be applied by coating the printable sheet by lithography, screen printing, application of curable silicone, and roll coating with the layers. Alternatively, the over-casting layers may be applied to the printable sheet by lamination. The layer or layers are generally applied over the visible and invisible images. The roll coat or lamination method are preferred for cost and performance reasons.

With respect to the layers, there are families of UV energy cross-linkable layers that provide the said printed silica-filled micro-porous materials with the desirable performance enhancements. By the nature of their molecular level changes during curing such layers enhance the tensile properties of the printed sheets reducing the tendency of the sheet to stretch as molten material flows over the sheet to its edges. Increasing the tensile properties also allows the use of thinner material such as seven mil thickness; this is important because it reduces the cross section presented at the sheet edge where an excessive thickness induces disruption of the material flow causing said sheet to lift from the mold surface. The increases in tensile properties are also of value in minimizing stretch thus making the printable sheets usable in a continuous roll fed sheet extrusion process where graphics are fused to extrudate as it is produced.

By the nature of the molecular changes that occur during curing, the layers also protect the ink during molding processes and provide the printable sheets with an increased surface coefficient of friction which significantly enhances the stability of the printed sheet within the mold during tortuous molding processes. Such sheet stability lowers the potential movement or float of the printed sheet as molten material flows over the sheet to its edges. The stability enhances high yield during tortuous molding processes.

When needed, such layers can be formulated and are commercially available which also enhance the resistance of the printed sheets from degradation by chemicals such as petroleum distillates and solvents which could contact the surface of the product in many applications. When needed such layers can also be formulated and are commercially available to enhance the resistance of any of the products to color fading from protracted exposure to UV light in outdoor or other high sunlight exposure applications. Such layers may also provide suitable dielectric performance so that printed and coated sheets can be held in the mold cavities using electrostatic means without the degradation or dissipation of the electrostatic charge prior to mold closure and completion of the molding process.

In accordance with an embodiment of the present invention, the coating may be a UV curable clear coating material having a coefficient of friction greater than 0.5. The coating may be a UV curable clear coating having a cured gloss of greater than 55%. Additionally, the coating may impart enhanced properties to the printable sheet. For example, the coating may impart outdoor resistance to UV induced image fading for five to ten years, resistance to image degradation from contact with petroleum based materials or solvents, and/or resistance to underfoot slippage of greater than a 0.6 coefficient of friction as tested under ASTM D2047.

The invention makes possible many new capabilities and opens many new opportunities in the field of in-mold decorating. First, the invention allows improving the quality of images that can be in-molded by implementing offset lithography, flexographic and gravure printing as options. Second, the invention provides in-molding approaches that are easier to implement and have lower production costs by enhancing the effectiveness of electrostatic adhesion and often allowing in-molding without modifying molds. Third, the invention provides products and images which are more robust and durable, particularly in the areas of UV induced fading, abrasion, and slip resistance in underfoot applications. Fourth, the invention provides methods that lower the scrap rates from unsuccessful attempts by improving the stability of the in-mold graphic element during molding and by positive fusion of the graphic element into the surface of the molded part. Fifth, the invention provides for implementation with minimum impact on production process cycle times, including the implementation of robotic handling, hence making in-mold decorating more cost competitive. Sixth, the invention provides the ability to implement in-mold decoration in thermosetting and vulcanization applications opening a plurality of new products to such decoration. Seventh, the invention provides for implementing in-mold and in-line decorating in a wider range of molding techniques including extrusion and thermoforming while simplifying injection molding and blow molding. Eighth, the invention provides a plurality of new options for decorated molded products through such applications as the manufacture of polyolefin products that can be screen printed without using specialized inks or corona treatments, the ability to attach metallized foils to molded parts, and the ability to attach pressure sensitive adhesive materials such as reflective tape to materials to which they would not otherwise adhere. Ninth, the invention provides new or improved opportunities for permanent product labeling in thermoplastic, thermosetting, and vulcanizable product applications allowing in-molding of safety labels, product identification labels, product serialization labels, product ownership labels for security purposes, part number labels, life cycle tracking labels, and production lot identification labels containing text, logos, graphics or barcodes. Tenth, the invention provides for identifying that said products have been altered or misused, thus providing an added security feature to the finished molded product. Eleventh, the invention allows for the in-mold decoration of deep dimensional and three dimensional molded parts. Twelfth, the invention eliminates concerns over the differences in polymer shrink rates between an in-moldable label and the polymer to which it is molded. Lastly, the invention allows manufacturers of an in-mold decorated product to have the image assume the texture of the underlying molded material as imparted by the mold surface due to the inherent flexibility of the sheet materials used.

Satisfactory, but not optimum, UV curable layers are available from a number of sources by specifying a clear coat that will adhere to lithographic printed images and which exhibits whatever performance factors such as those cited above are needed for the specific application. A suitable series of such layers has been optimized to enhance the most important properties for the majority of product applications is the GRA series of layers, which are clear variants of the screen inks previously cited. These layers are available from Fusion Graphics of Dayton Ohio. Such layers are UV crosslinkable layers containing an acrylate ester.

In accordance with an embodiment of the present invention, the label may have invisible ultraviolet (UV) ink printed over the visible image to produce a UV image. The UV image is configured to provide security information. The UV image may be produced by using any suitable UV ink. Examples of suitable UV inks include, but are not limited to, those available from Angstrom Technologies Inc. and Kennedy Ink Co. UV ink is generally invisible to the human eye unless placed under a UV light. For example, the UV ink may be visible when placed under a long wave UV light. The UV image may be any suitable image. For example, the image may be a dot matrix pattern, a bar code, or the image may be a block print that covers the visible image, and the UV images may comprise security information. The UV image may be layered with the layer or layers over the UV image. The UV images may be printed in any suitable manner. For example, the UV images may be printed utilizing lithography, screen printing, flexography, high resolution ink jet printing, and color or monochrome electrostatic laser printing. It is possible to manufacture multiple UV inks and with small variations in wavelength of the same color. This allows for printing, for example, a yellow solid bar image and then over the same solid bar print a yellow custom bar code image and then use the Raman spectroscopy process to determine the forensic validity of the images, we may also add a trace molecular chemical that only can be detected using spectroscopy, further adding additional levels of security.

It will be understood that the UV image may be excited by an UV light source and read electronically to detect the presence and shape of the UV image. Thus, the presence of the security information provided by the UV image may be verified, and the security information may be read to provide information such as the authenticity of the label. Additionally, the UV image may be read by electronic equipment to detect the rise and fall of the rates of absorption and reflection of the UV image and the density of the UV image. The rates of absorption and reflection and density are traits that may be controlled during the manufacturing process of the label, and these traits provide information that may be provided to verification equipment. These traits may comprise security information. The verification equipment may then be used to verify the identity and authenticity of the label by reading the security information provided by the invisible UV image.

In accordance with an embodiment of the present invention, the labels may be incorporated into plastic or rubber articles made from any suitable materials to form labeled articles. Suitable materials for the articles include polymers such as thermoplastic polymers and thermoset polymers. Suitable polymers include, but are not limited to, Polyolefin (polypropylene, polyethylene) polycarbonate, elastomers, polyamides, polystyrene, polyphenylene oxide, polyvinyl chloride, partially devulcanized crumb rubber, crumb rubber filled polymer, and acrylonitrile-butadiene-styrene. Suitable materials also include unvulcanized rubber. Transparent polymers may be used, and the labels may have a visible and/or invisible IR image printed on the front and the back of the labels. Additionally, recycled or regrind materials may be utilized to form the products of the present invention. The recycled or regrind materials may contain non-homogenous and variegated material derived from recycled or regrind stocks.

The labels of the present invention may be incorporated into plastic or rubber articles in any suitable manner. Generally, the labels are permanently fused into the surface of the plastic or rubber material during the manufacture of the article. The labels may be fused into the surface of suitable materials by any suitable process such as molding including thermosetting, vulcanization, and thermoplastic molding and extrusion. Because the labels are permanently fused into the surface of the plastic or rubber material during the manufacture of the article, the labels are essentially tamper proof. Any attempt to remove the label will irreversibly alter the surface of the plastic or rubber material, and such alteration of the surface will be apparent. Thus, the labels provide embedded security information that may be unique to the product.

The labels exhibit high stability in the mold during molding, and the labels may be used in a wide variety of molding techniques. The labels may introduced into a mold, contacted with the article material, and the labels may then be fused into the article during the molding process. Suitable molding processes include injection, blow, thermoforming, gas assist, structural foam, compression, and rotational molding. The labels may be permanently fused into the surface of an article during extrusion and vulcanization processes.

The labels of the present invention may exhibit improved positional stability in a mold. For example, the label may have dielectric properties that permit positionally stable placement using electrostatic charging of the printable sheet in any position within a mold for over 30 seconds including during the molding process. Such dielectric properties may be imparted by the layers as discussed herein. In another example, the label may have a coefficient of friction between the printable sheet and a mold surface sufficient to resist the force of molding material flowing over the molding side of the printable sheet. Additionally, the label may have a surface that softens sufficiently to produce adhesion to a mold surface sufficient to resist the force of molding material flowing over the molding side of the printable sheet.

The labels of the present invention may be thermoformed to fit complex mold face geometries. For example, the label may be incorporated into a product have a raised area or areas. Additionally, the products may be decorated post mold using any suitable technique such as pad printing, heat transfer, foil transfer, screen printing, airbrush, and application of an adhesive label. In a further example, the label may comprise a three dimensional printable sheet printed with visible and invisible images as discussed herein. The three dimensional label may be molded with a suitable product to produce a labeled three dimensional product. The label may be made three dimensional by a method selected from heat welding, vacuum forming, ultrasonic welding, and coining, and combinations thereof.

It will be understood that the label may be manufactured to contain graphic visible and invisible images that are unique to a labeled article. Additionally, the absorption, reflection, and density of the IR and UV images may be controlled during manufacturing, and changes in these rates may be used to identify a particular labeled article. Using the Raman spectrographic technologies allows for the fused label to be uniquely identified, i.e. as a "fingerprint" or "DNA" for that image. The ability to deposit these images as unique individually electronic printed imagery with lots code provide all the aspects to handle fraudulent and gray market distribution of products.

In accordance with another aspect of the present invention, a system for providing security information is provided. The system comprises a labeled article as discussed herein having security information provided thereon. The system additionally comprises a verification system that comprises verification equipment. The verification equipment that is capable of electronically reading IR and UV images. The verification equipment may be programmed to interpret the IR and UV images in any desired manner. For example, the verification equipment may be programmed to verify the security information provided on the labeled product. Additionally, the verification equipment may be electronically provided with expected changes in the absorption or reflection of the IR and/or UV images, and the expected changes may be used to verify the identity and authenticity of the labeled product.

EXAMPLES

The present invention is illustrated by the following representative, but non-limiting, examples.

Example 1

A sheet of PPG Industries MiST® seven mil thick material is printed with a using offset lithography four color process image using inks from the Grafusion™ series. The printed image is then coated via screen printing using GRA-C501 coating and is then die cut to the shape of a control panel label. The die cut piece is then positioned in the cavity of an injection mold and is electrostatically treated using a Tantec High Voltage Electrostatic Charging Device. The mold is then closed and the control panel part is injection molded using polypropylene. When the mold opens a control panel part containing said graphic fused into the appropriate part of its surface is ejected. This example demonstrates the capability of the invention to replace post molding decorating where prior state of the art in-mold decorating techniques were unable to provide a satisfactory solution. The resulting part is suitable for use by the customer in lieu of a part where previously an adhesive label had been applied in a post molding operation.

Example 2

A sheet of PPG Industries MiST® ten mil thick material is printed with text, a logo, and a unique serialized barcode using a high temperature carbon ink ribbon in an Intermec 4440 printer. The sheet is then scored with an intersecting cross hatch. The printed and scored sheet is then given a silicone coating on the printed side. The rear side of the printed sheet is coated with unvulcanized rubber and said sheet is placed on the sidewall of an unvulcanized tire. The tire then undergoes vulcanization producing a finished tire containing a permanent label providing tire ownership information and serialization for tracking the tire during the remaining manufacturing steps and as part of a tire inventory throughout its useful life. The tire with label attached undergoes temperature and flexure testing to simulate on the road conditions and the label remains intact. The label is cleaned using gasoline and typical solvents such as toluene, heptane, and methyl-ethyl-ketone and it shows no degradation of the image with the barcode remaining readable using automatic barcode reading equipment. This example demonstrates the capability of the invention to place a permanent and durable in-mold decoration onto a part in a thermosetting process. The product provides the tire owner with increased security against theft of his tires and a method of tracking the use and recapping of the tire throughout its useful life. The cross hatch cutting has resulted in a label that flexes, but does not permanently deform in extreme flexure, with the tire while in use.

Example 3

A sheet of ten mil Daramic™ material is printed via offset lithography using Grafusion series inks and is then screen coated using GRA-C501 coating. The sheet is then placed in the cavity of a mold designed for blow molding a water bottle and is momentarily exposed to electrostatic energy. The mold is then closed and a bottle is blow molded using polyethylene. When the mold is opened a bottle with a permanent image fused into its surface is removed.

Example 4

A sheet of PPG Industries MiST® ten mil thick material is printed with text, a logo, and a unique serialized barcode using a high temperature carbon ink ribbon in an Intermec 4440 printer and is then coated using GRA-C501 coating. The printed and coated sheet is then placed in a thermoforming mold with a sheet of polyethylene and a part is molded using vacuum forming. When the mold is opened the part has a permanent barcode label fused into its surface.

Example 5

A roll of ten mil Daramic™ material, ten inches wide is printed via four color process flexography and is then screen coated using GRA-C501 coating at the end of the flexographic process. The roll is then separated into individual images that are placed in the cavity of a mold designed for injection molding a carrying case and is momentarily exposed to electrostatic energy. The mold is then closed and a case is molded using polypropylene. When the mold is opened a case with a permanent image fused into its surface is removed.

Example 6

A sheet of unprinted 10 mil MIST® is fused to the surface of a rubber sheet during extrusion. The sheet is then cut to a specified shape and placed in an injection mold with the rubber against the mold surface and the MIST® side exposed to the injection of polypropylene. When the polypropylene is injected it fuses to the MIST® and creates a part that is part rubber and part plastic having a permanent bond, without adhesives, between two materials that would not normally bond to one another. The resulting product approximates a shoe sole.

It will be obvious to those skilled in the art that various changes may be made without departing from the scope of the invention, which is not to be considered limited to what is described in the specification.

What is claimed is:

1. A system for providing and verifying security information on in-mold labeled articles, said system comprising:

an article comprising a material selected from the group consisting of plastic, rubber, and combinations thereof;

a label permanently fused into a surface of said article during a molding process, said label comprising:

a single-layer printable sheet comprising a microporous material having a thickness of 10 mil (0.010 inches; 0.254 mm) or less, said single-layer printable sheet lacking an additional adhesive substance on a fusion surface of said single-layer printable sheet;

at least one printed image on a first surface of said single-layer printable sheet, said at least one printed image comprising a security feature that provides security information;

a layer of a cured polymeric material disposed over said first surface and said at least one printed image, the combination of said microporous material and said layer of cured polymeric material increasing the surface coefficient of friction and tensile strength of said single-layer printable sheet so as to resist movement and stretching of said single-layer printable sheet in a mold when a molten plastic or a molten rubber flows over said single-layer printable sheet during said molding process, such that said fusion surface of said single-layer printable sheet is permanently fused into said surface of said article without an intervening adhesive between said label and said article; and a verification system comprising verification equipment that verifies the security information provided by said security feature on said label.

2. The system of claim 1, wherein said at least one printed image comprises a bar code and said verification system comprises a bar code reader.

3. The system of claim 1, wherein said at least one printed comprises a production lot identification containing text, logos, graphics, barcodes, or combinations thereof.

4. The system of claim 1, wherein the microporous material is a precipitated silica filled microporous material.

5. The system of claim 1, wherein said cured polymeric material is a UV cured polymeric material.

* * * * *

UNITED STATES PATENT AND TRADEMARK OFFICE

CERTIFICATE OF CORRECTION

PATENT NO. : 8,062,737 B2
APPLICATION NO. : 12/056682
DATED : November 22, 2011
INVENTOR(S) : Fredric Louis Abrams et al.

It is certified that error appears in the above-identified patent and that said Letters Patent is hereby corrected as shown below:

Title Page, insert Item --(73) Assignee: The Standard Register Company, Dayton, OH (US)--

Col. 7, Line 6, "may introduced" should read --may be introduced--

Col. 7, Line 29, "into a product have a raised" should read --into a product having a raised--

Col. 9, Lines 23, 26 and 28, "MIST®" should read --MiST®--

Col. 10, Claim 3, Lines 32-33, "at least one printed comprises" should read --at least one printed image comprises--

Signed and Sealed this
Thirteenth Day of March, 2012

David J. Kappos

David J. Kappos
*Director of the United States Patent and Trademark Office*